United States Patent [19]

Perrotti

[11] 4,117,488

[45] Sep. 26, 1978

[54] MULTIPURPOSE, MULTIFUNCTION ANTENNA

[75] Inventor: Emmanual Joseph Perrotti, Ramsey, N.J.

[73] Assignee: International Telephone and Telegraph Corp., Nutley, N.J.

[21] Appl. No.: 651,090

[22] Filed: Jan. 21, 1976

[51] Int. Cl.[2] ..... H01Q 21/24; H01Q 15/24

[52] U.S. Cl. ..... 343/100 PE; 343/756

[58] Field of Search ..... 343/100 PE, 756

[56] References Cited

U.S. PATENT DOCUMENTS

| | | | |
|---|---|---|---|
| 2,619,635 | 11/1952 | Chait | 343/100 PE |
| 3,453,617 | 7/1969 | Begeman et al. | 343/100 PE |
| 3,827,051 | 7/1974 | Foldes | 343/100 PE |

*Primary Examiner*—Nelson Moskowitz
*Assistant Examiner*—Richard E. Berger
*Attorney, Agent, or Firm*—John T. O'Halloran; Alfred C. Hill

[57] ABSTRACT

A dual circularly polarized radiating and receiving arrangement is coupled to a dual circular polarizer which has coupled thereto a transmit port and a receive port. A circuit arrangement is coupled to both of the ports to enable radiation of a selected one of vertical linearly polarized waves, one of right hand and left hand dual circularly polarized waves and linearly polarized waves having a selected angle of polarization and reception of the other of the right hand and left hand dual circularly polarized waves.

3 Claims, 2 Drawing Figures

MULTIPURPOSE, MULTIFUNCTION ANTENNA

BACKGROUND OF THE INVENTION

This invention relates to communication systems, radar systems and electronic countermeasure systems and more particularly to an antenna for such systems.

In the usual design of a given system the antenna subsystem is dedicated to a particular function, such as a full duplex communication, radar, or various electronic countermeasure functions. With the advent of more advanced, highly mobile and limited payload systems, it has been apparent that all subsystems including the antennas are desired to have multipurpose, multifunction capabilities. In the interest of saving development costs, system architects are trying to utilize existing hardware as much as possible, but in the antenna area they have run into problems because of the polarization constraints inherent in existing antennas.

SUMMARY OF THE INVENTION

An object of the present invention is to provide a multipurpose, multifunction antenna.

A feature of the present invention is the provision of a multipurpose, multifunction antenna comprising: a dual circularly polarized radiating and receiving means; a dual circular polarizer coupled to the means; a transmit port coupled to the polarizer; a receive port coupled to the polarizer; and a circuit arrangement coupled to the transmit and receive ports to enable radiation of a selected one of vertical linearly polarized waves, one of right hand and left hand dual circularly polarized waves and linearly polarized waves having a selected angle of polarization and reception of the other of right hand and left hand dual circularly polarized waves.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
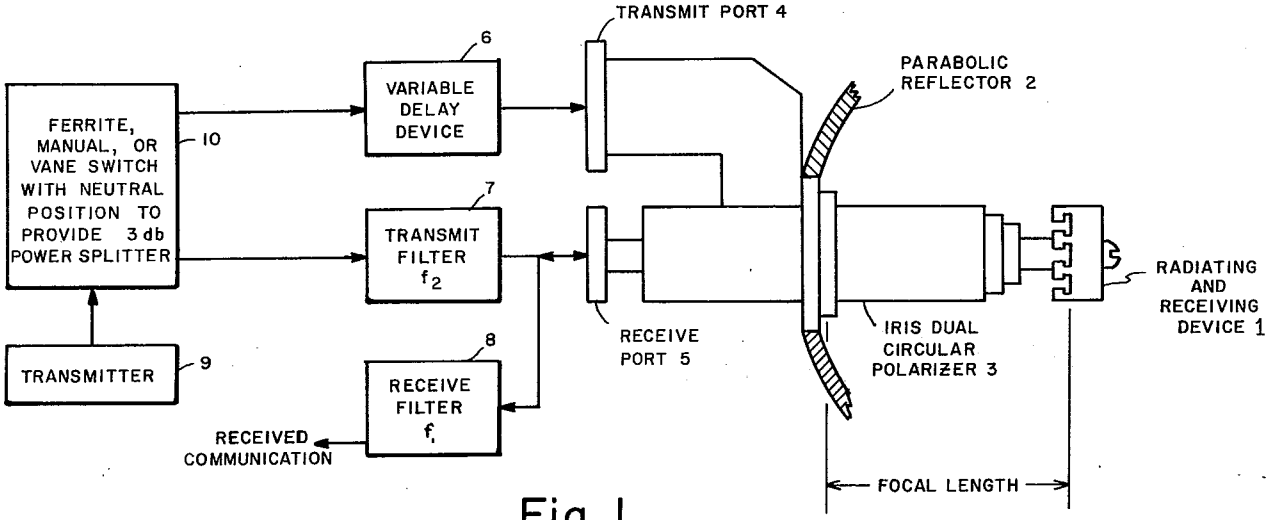
FIG. 1 is a schematic illustration of a multipurpose, multifunction antenna in accordance with the principles of the present invention.

Many communication antennas whether they are arrays or continuous apertures are full duplex, dual circularly polarized devices. Such a device is illustrated in FIG. 1 as a conventional backsplash feed dual circularly polarized antenna which includes a radiating and receiving means including radiating and receiving device 1 and parabolic reflector 2 coupled to an iris type dual circular polarizer 3 which has coupled thereto a transmit port 4 and a receive port 5.

However, it is to be understood that the antenna need not be restricted to this particular type of antenna in association with the additional circuits to be described hereinbelow, but may be any dual circularly polarized antenna, such as arrays, continuous apertures, or descrete radiators, such as horns, crossed dipoles and the like. The circuit arrangement which renders the antenna of FIG. 1 multipurpose and multifunction includes a variable delay device 6 coupled to transmit port 4, a transmit filter 7 coupled to receive port 5 and a receive filter 8 also coupled to receive port 5. Transmitter 9 is coupled through switch 10 to either or both of device 6 and filter 7. Switch 10 may be a ferrite, manual or vane switch with a neutral position to provide a 3 db (decibel) power splitter so that the transmitter power can be coupled simultaneously to device 6 and filter 7. With this additional circuitry, there is provided a multipurpose, multifunction antenna which can provide dual circular polarization, vertical linearly polarized waves and linearly polarized waves having a selected angle of polarization to provide "spin" linear polarization. The antenna of FIG. 1 with the additional equipment can be used for communication systems, radar systems, and electronic countermeasure systems.

The antenna of FIG. 1 operates as follows. As an example assume that the antenna must function as a dual circularly polarized communication antenna and a linearly polarized radar antenna and that the radar frequencies are within the communication transmit band $f_2$. For the communication mode of operation switch 10 is positioned so that transmit port 4 is energized only from transmitter 9. In this switch position only one hand of circularly polarized waves will be transmitted and the communication receiver will be responsive to the opposite hand of circularly polarized waves and routed through filter 8 to the rest of the communication receiver.

Figure 2:
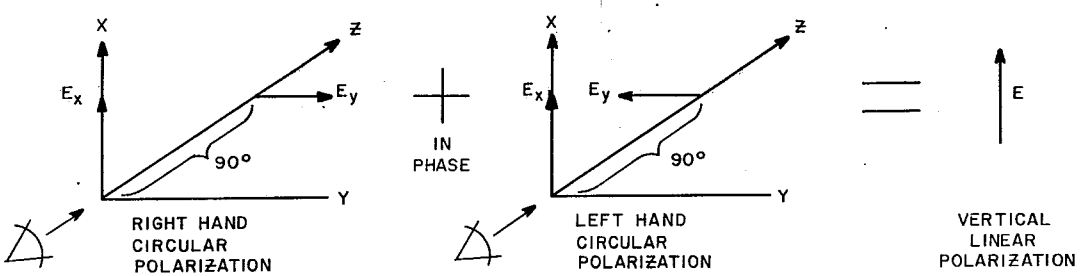
FIG. 2 is a graphical illustration useful in explaining the operation of the antenna of FIG. 1.

For the radar operation mode which employs linearly polarized waves, switch 10 is positioned in its neutral position thereby providing a 3 db power splitter which enables coupling power from transmitter 9 to both device 6 and filter 7. Device 6 is set so as to compensate for the additional delay introduced by filter 7. Under these conditions, the transmitter signal is transmitted in phase into ports 4 and 5 and the result due to the action of polarizer 3 is a vertical linear polarized wave such as illustrated in FIG. 2.

If device 6 is set to a different delay so that the dual circularly polarized components are not in phase in polarizer 3, the resultant linearly polarized vector will be rotated. It can be shown that the angle of rotation will be one half the electrical angle of the phase difference between the left hand circularly polarized waves and the right hand circularly polarized waves. Thus "spin"polarization can be provided which could be useful in electronic countermeasure system, or for optimizing communication reception and transmission for cases of polarization rotation.

While I have described above the principles of my invention in connection with specific apparatus it is to be clearly understood that this description is made only by way of example and not as a limitation to the scope of my invention as set forth in the objects thereof and in the accompanying claims.

I claim:

1. A multipurpose multifunction antenna comprising:

a dual circularly polarized radiating and receiving means;

a dual circular polarizer coupled to said means;

a transmit port coupled to said polarizer;

a receive port coupled to said polarizer; and a circuit arrangement coupled to said transmit and receive ports to enable radiation of a selected one of vertical linearly polarized waves, one of right hand and left hand dual circularly polarized waves and linearly polarized waves having a selected angle of polarization and reception of the other of right hand and left hand dual circularly polarized waves;

said polarizer being an iris circular polarizer;

said means including a backsplash radiating and receiving device coupled to said polarizer disposed at the focal point of a reflector;

said reflector being a parabolic reflector; and said circuit arrangement including a transmitter, a variable delay device coupled to said transmit port, a transmit filter coupled to said receive port, a receive filter coupled to said receive port, a switch having a neutral position to provide a three decibel power splitter coupled to said transmitter, said delay device and said transmit filter.

2. A multipurpose multifunction antenna comprising:

a dual circularly polarized radiating and receiving means;

a dual circular polarizer coupled to said means;

a transmit port coupled to said polarizer;

a receive port coupled to said polarizer; and a circuit arrangement coupled to said transmit and receive ports to enable radiation of a selected one of vertical linearly polarized waves, one of right hand and left hand dual circularly polarized waves and linearly polarized waves having a selected angle of polarization and reception of the other of right hand and left hand dual circularly polarized waves;

said means including a backsplash radiating and receiving device coupled to said polarizer disposed at the focal point of a reflector;

said reflector being a parabolic reflector; and said circuit arrangement including a transmitter, a variable delay device coupled to said transmit port, a transmit filter coupled to said receive port, a receive filter coupled to said receive port, a switch having a neutral position to provide a three decibel power splitter coupled to said transmitter, said delay device and said transmit filter.

3. A multipurpose multifunction antenna comprising:

a dual circularly polarized radiating and receiving means;

a dual circular polarizer coupled to said means;

a transmit port coupled to said polarizer;

a receive port coupled to said polarizer; and a circuit arrangement coupled to said transmit and receive ports to enable radiation of a selected one of vertical linearly polarized waves, one of right hand and left hand dual circularly polarized waves and linearly polarized waves having a selected angle of polarization and reception of the other of right hand and left hand dual circularly polarized waves;

said circuit arrangement including a transmitter, a variable delay device coupled to said transmit port, a transmit filter coupled to said receive port, a receive filter coupled to said receive port, a switch having a neutral position to provide a three decibel power splitter coupled to said transmitter, said delay device and said transmit filter.

* * * * *